US006920847B2

(12) United States Patent
Hiyoshi et al.

(10) Patent No.: US 6,920,847 B2
(45) Date of Patent: Jul. 26, 2005

(54) RECIPROCATING ENGINE WITH A VARIABLE COMPRESSION RATIO MECHANISM

(75) Inventors: Ryosuke Hiyoshi, Kanagawa (JP); Kenshi Ushijima, Kanagawa (JP); Yoshiteru Yasuda, Yokohama (JP); Katsuya Moteki, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/756,470

(22) Filed: Jan. 14, 2004

(65) Prior Publication Data

US 2004/0163614 A1 Aug. 26, 2004

(30) Foreign Application Priority Data

Feb. 24, 2003 (JP) ..... 2003-045709

(51) Int. Cl.[7] ..... F02B 75/04
(52) U.S. Cl. ..... 123/48 B; 123/78 F; 123/196 R
(58) Field of Search ..... 123/48 R, 48 B, 123/78 E, 78 F, 196 R

(56) References Cited

U.S. PATENT DOCUMENTS

| | | | | |
|---|---|---|---|---|
| 4,195,601 A | | 4/1980 | Crise | |
| 5,247,911 A | * | 9/1993 | Nenicka | 123/78 E |
| 6,397,796 B1 | * | 6/2002 | Styron et al. | 123/78 E |
| 6,505,582 B2 | | 1/2003 | Moteki et al. | |
| 6,736,091 B1 | * | 5/2004 | Tibbles | 123/78 E |

FOREIGN PATENT DOCUMENTS

| | | |
|---|---|---|
| EP | 1 170 482 A2 | 1/2002 |
| EP | 1 178 194 A2 | 2/2002 |
| JP | 2002-21592 A | 1/2002 |

* cited by examiner

*Primary Examiner*—Noah P. Kamen
(74) *Attorney, Agent, or Firm*—Foley & Lardner LLP

(57) ABSTRACT

A reciprocating engine with a variable compression ratio mechanism is disclosed. A lubrication system of the engine is improved by controlling an oil pressure according to a compression ratio setting. The lubrication system includes various combinations of control valves and oil passages. The oil relief passage is opened at a high compression ratio setting applied to a low engine load range and is otherwise closed at a low compression ratio setting applied to a high engine load range.

21 Claims, 12 Drawing Sheets

AT HIGH COMPRESSION RATIO

AT LOW COMPRESSION RATIO

AT LOW SPEED AND LOW LOAD

AT HIGH SPEED AND HIGH LOAD

AT HIGH COMPRESSION RATIO 1

AT HIGH COMPRESSION RATIO 2

AT LOW COMPRESSION RATIO

AT HIGH COMPRESSION RATIO

AT LOW COMPRESSION RATIO

AT HIGH COMPRESSION RATIO

AT LOW COMPRESSION RATIO

AT HIGH COMPRESSION RATIO

AT LOW COMPRESSION RATIO

AT HIGH COMPRESSION RATIO

AT LOW COMPRESSION RATIO

AT HIGH COMPRESSION RATIO

AT LOW COMPRESSION RATIO

AT HIGH COMPRESSION RATIO

AT LOW COMPRESSION RATIO

RECIPROCATING ENGINE WITH A VARIABLE COMPRESSION RATIO MECHANISM

BACKGROUND OF THE INVENTION

The present invention relates generally to a reciprocating internal combustion engine with a variable compression ratio mechanism including a multiple-link type piston crank mechanism, and more particularly to an improvement in a lubrication system of the engine.

Recent years, there have been disclosed various variable compression ratio mechanisms of a reciprocating internal combustion engine with a multiple-link type piston crank mechanism which are capable of varying the top dead center (TDC) position and/or the bottom dead center (BDC) of a piston and the engine compression ratio by displacing a part of elements of the linkage. One such mechanism is disclosed in Japanese Patent Provisional Publication No. 2002-21592 published Jan. 23, 2002 (corresponding to U.S. Pat. No. 6,505,582 assigned to the assignee of the present invention Jan. 14, 2003). This variable compression ratio mechanism includes an upper link connected at one end to a piston with a piston pin, a lower link oscillatably or rockably pin-connected to the other end of the upper link with an upper pin and rotatably attached to a crankpin of a crankshaft, a control link oscillatably pin-connected at one end to the lower link with a control pin, a control shaft rotatably mounted onto a cylinder block and having an eccentric cam oscillatably supporting the other end of the control link, for varying the engine compression ratio by regulating the position of the eccentric cam of the control shaft according to an engine operating condition.

SUMMARY OF THE INVENTION

In the aforementioned reciprocating engine with a variable compression ratio mechanism, lubrication is necessary for three elements, that is, a control shaft, a control pin and an upper pin in addition to general lubricated elements such as a crankshaft, a crankpin and a piston pin. There is a possibility accordingly that an inadequate oil supply leads to a trouble in the lubrication of a piston skirt and bearings under a high engine load condition. If the oil pressure or the oil supply is excessively increased as a countermeasure against a lubrication trouble, an excessive oil supply for less oil demand leads to a useless work of the oil pump, which consequently results in a low fuel efficiency.

Accordingly, it is an object of the present invention to improve a lubrication system of a reciprocating engine with a variable compression ratio mechanism.

In order to accomplish the aforementioned and other objects of the present invention, a reciprocating engine comprises a variable compression ratio mechanism for regulating an engine compression ratio according to an engine load, a main oil passage, an oil pressure source hydraulically connected to the main oil passage for supplying pressurized lubricating oil to the main oil passage, an oil supply passage hydraulically connecting the main oil passage to a lubricated element, and an oil pressure control device for controlling an oil pressure in the main oil passage according to the engine compression ratio.

According to another aspect of the invention, a reciprocating engine comprises a variable compression ratio mechanism for regulating an engine compression ratio, a main oil passage, an oil pressure source hydraulically connected to the main oil passage for supplying pressurized lubricating oil to the main oil passage, an oil supply passage hydraulically connecting the main oil passage to a lubricated element, and an oil pressure control device for controlling an oil pressure in the main oil passage according to an engine load which is a parameter used to determine the engine compression ratio.

According to a further aspect of the invention, a reciprocating engine comprises a variable compression ratio mechanism for regulating an engine compression ratio according to an engine load, a main oil passage, an oil pressure source hydraulically connected to the main oil passage for supplying pressurized lubricating oil to the main oil passage, oil supply means for supplying lubricating oil from the oil pressure source via the main oil passage to a lubricated element, and oil pressure control means for controlling an oil pressure in the main oil passage according to the engine compression ratio.

According to a still further aspect of the invention, a reciprocating engine comprises a variable compression ratio mechanism for regulating an engine compression ratio, a main oil passage, an oil pressure source hydraulically connected to the main oil passage for supplying pressurized lubricating oil to the main oil passage, oil supply means for supplying lubricating oil from the oil pressure source via the main oil passage to a lubricated element, and oil pressure control means for controlling an oil pressure in the main oil passage according to an engine load which is a parameter used to determine the engine compression ratio.

According to another aspect of the invention, a method of regulating an oil pressure in a main oil passage of a reciprocating engine including at least a variable compression ratio mechanism for regulating an engine compression ratio, a main oil passage, an oil pressure source hydraulically connected to the main oil passage for supplying pressurized lubricating oil to the main oil passage, an oil supply passage hydraulically connecting the main oil passage to a lubricated element, and an oil pressure control device for controlling an oil pressure in the main oil passage, the method comprises determining whether the engine compression ratio is high or low relative to a predetermined value, operating the oil pressure control device for keeping the pressure in the main oil passage when the engine compression ratio is low, and operating the oil pressure control device for lowering the pressure in the main oil passage when the engine compression ratio is high.

The above objects and other objects, features, and advantages of the present invention are readily apparent from the following detailed description of the best modes for carrying out the invention when taken in connection with the accompanying drawings.

DETAILED DESCRIPTION OF THE INVENTION

Figure 1:
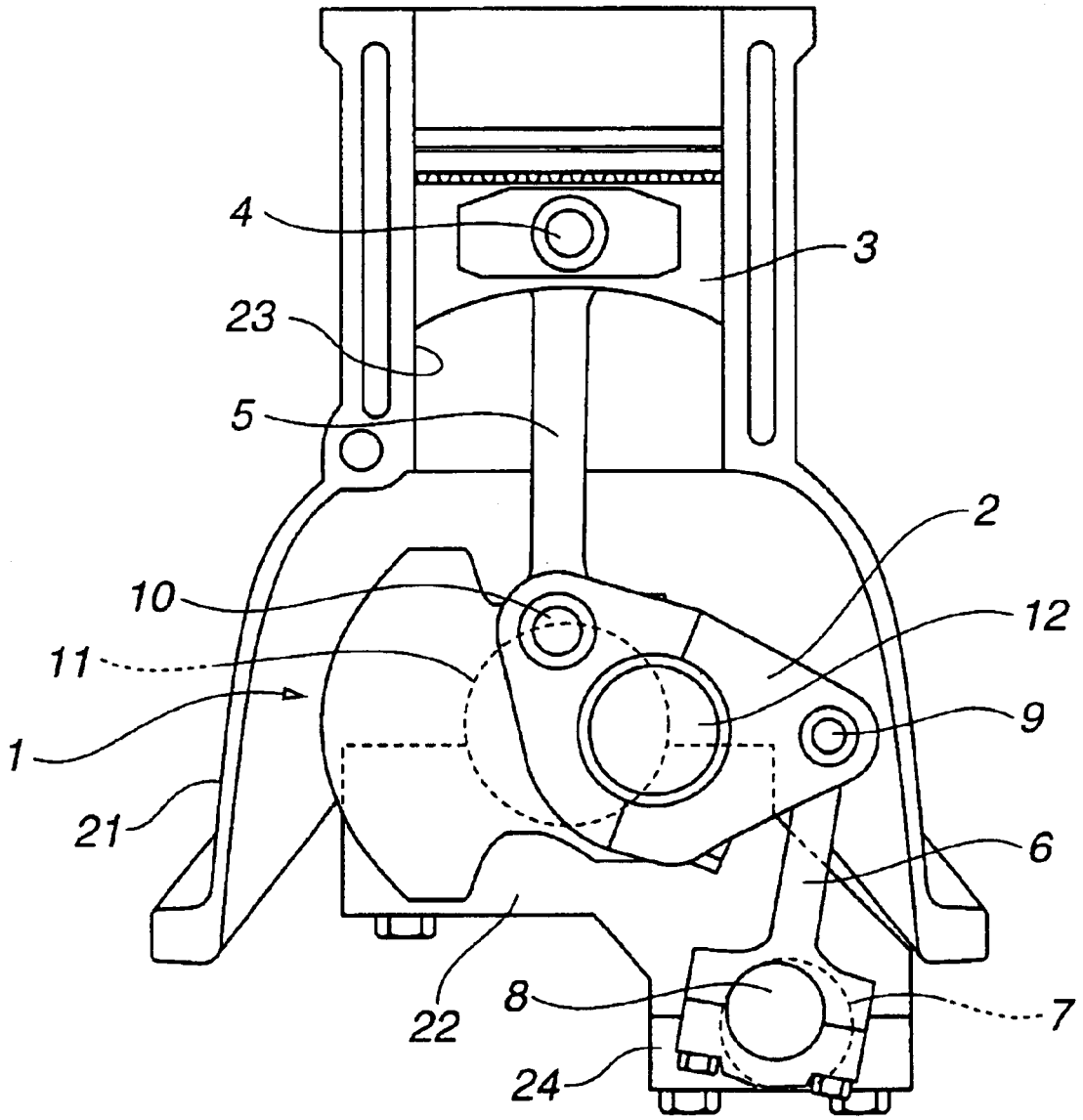
FIG. 1 is a cross-sectional view of a variable compression ratio mechanism of a reciprocating engine of the present invention.
Figure 2A:
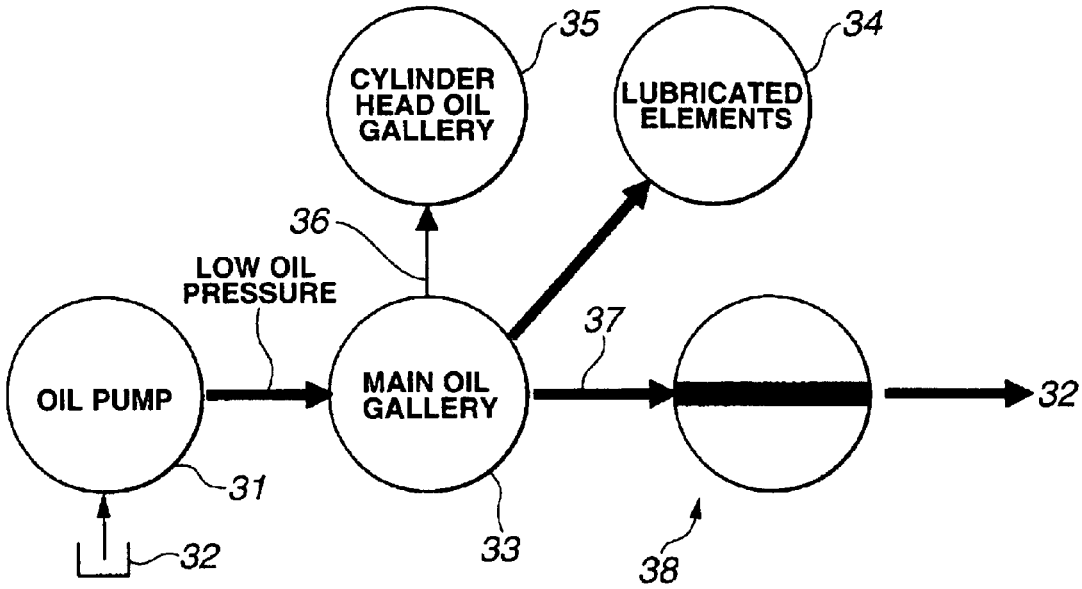
FIG. 2A is a block diagram depicting a lubrication system of a 1st embodiment of the present invention at a high engine compression ratio setting.
Figure 2B:
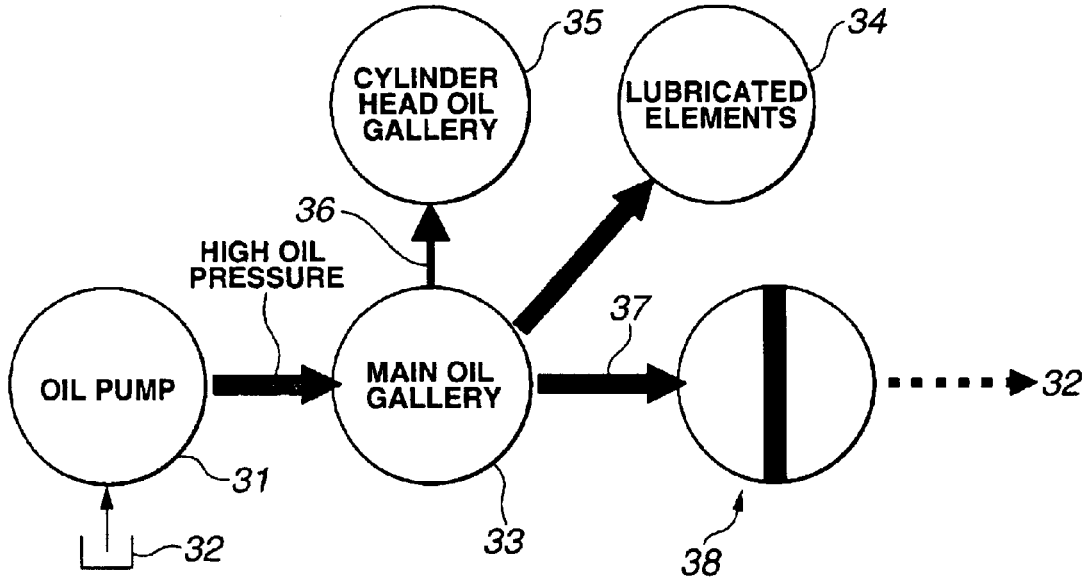
FIG. 2B is a block diagram depicting the lubrication system of the 1st embodiment of the present invention at a low engine compression ratio setting.

Referring now to the drawings, particularly to FIGS. 1 through 2B, there is shown a variable compression ratio mechanism common to all embodiments described later.

The variable compression ratio mechanism includes a lower link 2 rotatably attached to a crankpin 12 of a crankshaft 1, an upper link 5 connecting lower link 2 to a piston 3, a control shaft 7 having an eccentric cam 8, and a control link 6 connecting eccentric cam 8 to lower link 2. The rotation angle of control shaft 7 is varied by a compression-ratio control actuator 51 (described later, refer to FIG. 5) mainly according to the engine load condition. The motion restriction condition of lower link 2 by control link 6 is changed accordingly, so that the characteristics of the stroke of piston 3, specifically, the TDC position and/or the BDC position and the engine compression ratio of piston 3 are varied or controlled.

More specifically, crankshaft 1 includes a plurality of journals 11 and crankpins 12. Each journal 11 is rotatably supported on a main bearing between a cylinder block 21 and a crankshaft bearing cap 22. Lower link 2 is rotatably attached to crankpin 12 which has a predetermined eccentricity from the rotation center of journal 11. Lower link 2 consists of two split members. Crankpin 12 is mated with a connecting hole defined between the two split members of lower link 2. Upper link 5 is pivotally connected at a lower end via an upper pin 10 to one end of lower link 2, and also pivotally connected at an upper end via a piston pin 4 to piston 3. Piston 3 is reciprocated in a cylinder bore 23 of cylinder block 21 by the burning pressure. Control link 6 is pivotally connected at a small end or an upper end via a control pin 9 to the other end of lower link 2, and oscillatably or rockably connected at a big end or a lower end to eccentric cam 8 of control shaft 7. Control shaft 7 is placed parallel to crankshaft 1 and rotatably supported on a main bearing between crankshaft bearing cap 22 and a control-shaft bearing cap 24 attached on the lower side of crankshaft bearing cap 22. Eccentric cam 8 is offset from the rotation center of control shaft 7. Control-shaft bearing cap 24 is formed as a ladder-shaped or a bearing beam structure where a plurality of bearing caps are connected to a beam along the longitudinal direction of the engine.

Figure 5:
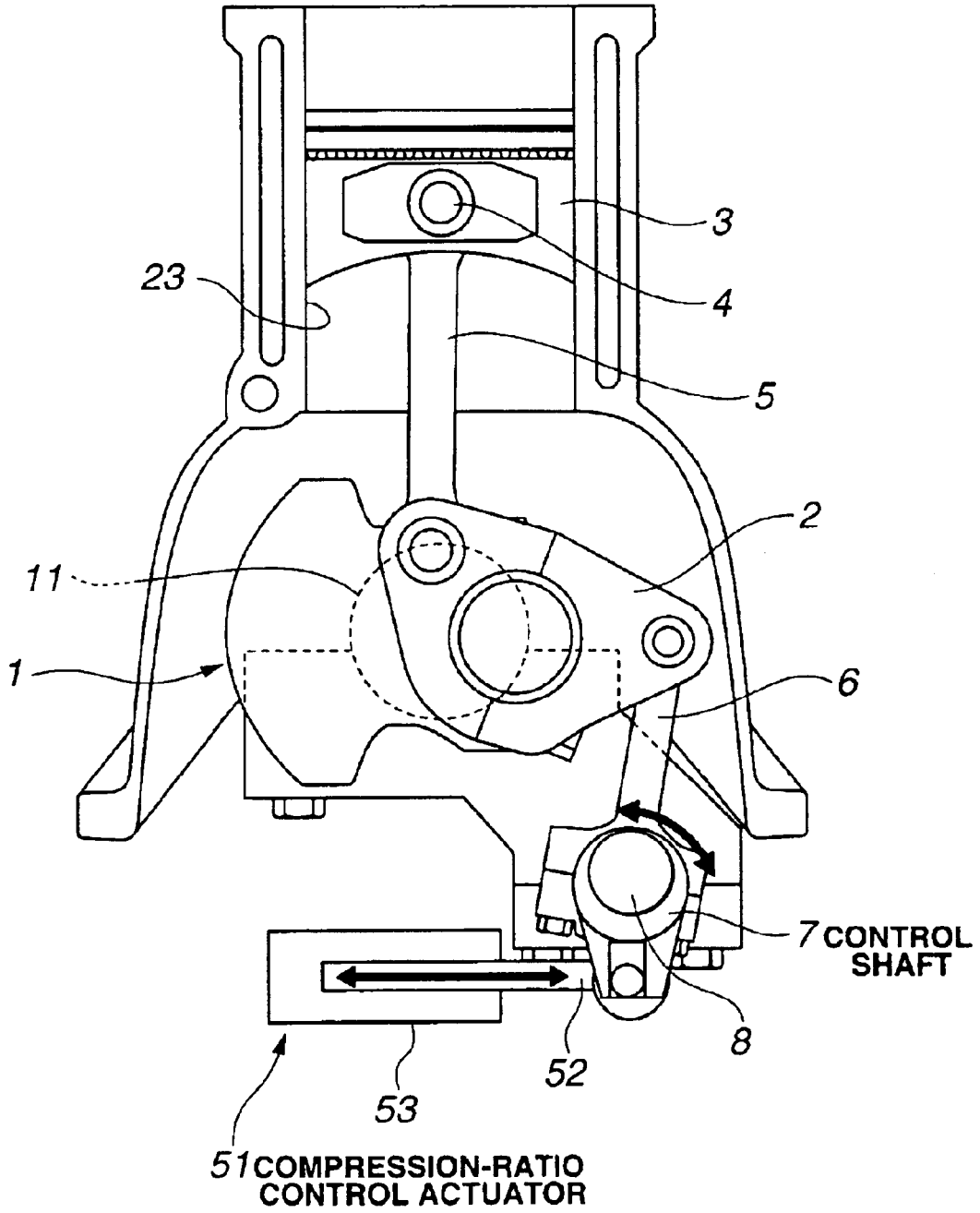
FIG. 5 is a cross-sectional view of a variable compression ratio mechanism of a 4th embodiment of the present invention, which includes a compression-ratio control actuator as a part of the system.

The rotation angle of control shaft 7 is regulated or controlled by a compression-ratio control actuator including an electric motor, such as compression-ratio control actuator 51 shown in FIG. 5, according to the control signal from an engine control unit (not shown). The compression-ratio control actuator rotates control shaft 7 to displace the center of eccentric cam 8 and to raise or lower the oscillating center at a lower end of control link 6. Accordingly, the geometry of lower link 2 at TDC is changed to raise or lower the position of piston 3 at TDC. Therefore it is possible to vary the compression ratio. This control of the compression ratio is operated based on an engine operating condition, generally sets a lower compression ratio to a higher engine load condition.

As shown in FIGS. 2A and 2B, an oil pump 31 as an oil pressure source, which is driven by the torque of crankshaft 1, sumps lubricating oil stored in an oil pan 32, pressurizes the lubricating oil and feeds a main oil gallery 33 as a main oil passage formed in cylinder block 21 (refer to FIG. 1) under pressure. The oil supplied to main oil gallery 33 is distributed to a plurality of lubricated elements 34 (oil supplied elements) in cylinder block 21, such as bearings on crankshaft 1 which elements are necessary to be lubricated. The oil in main oil gallery 33 is partly supplied via a cylinder head main oil supply passage 36 to a cylinder head oil gallery 35 formed in the cylinder head. The oil is mainly supplied to a plurality of lubricated elements (not shown) such as a valve train and a bearing on a camshaft in the cylinder head. The oil returns to oil pan 32 after lubricating the lubricated elements. In FIGS. 2A, 2B, a thickness of a line such as oil passages 36, 37 is corresponding to an oil pressure or an oil quantity, as a higher oil pressure or a larger oil quantity is shown as a thicker line and a lower oil pressure or a smaller oil quantity is shown as a thinner line. In other drawings depicting a lubrication system, the same symbols are applied.

The oil pressure in main oil gallery 33 pressurized by oil pump 31 mainly depends on the engine speed, because oil pump 31 is driven by the torque of crankshaft 1. The oil pressure necessary for supplying lubricating oil properly to the lubricated elements varies mainly according to the engine load condition. In general, a higher engine load condition demands a higher oil pressure. In the aforementioned reciprocating engine with a variable compression ratio mechanism, lubrication is necessary for three elements, that is, a control shaft, a control pin and an upper pin in addition to general lubricated elements such as a crankshaft, a crankpin and a piston pin. Accordingly, there is a possibility that inadequate oil supply leads to a trouble in the lubrication of a piston skirt and bearings under a high engine load condition. If oil pressure or oil supply is excessively increased as a countermeasure against a lubrication trouble, an excessive oil supply for less oil demand leads to a useless work of the oil pump, which consequently results in a low fuel efficiency.

In order to improve the mechanism, the following embodiments include oil pressure control means for regulating the oil pressure in main oil gallery 33 according to the compression ratio set by the variable compression ratio mechanism or to the engine load condition. Consequently, lubricating oil is properly supplied to the lubricated elements according to the compression ratio setting or the engine load condition. Under a low engine load condition where a high compression ratio is applied, the oil pressure is lowered to reduce a work loss of the oil pump for the improvement of fuel efficiency. On the other hand, under a high engine load condition where a low compression ratio is applied, oil pressure in main oil gallery 33 is kept high without falling. Lubricating oil is thus enough supplied to lubricated elements to prevent securely seizes and lubrication failures at the lubricated elements.

In all following embodiments, the oil pressure control means include oil relief passage 37 connected to main oil gallery 33 for relieving oil from main oil gallery 33, a control valve (such as a valve 38 in a first embodiment) as an oil pressure regulating mechanism for regulating the oil pressure in main oil gallery 33 by selecting or changing the opening of oil relief passage 37 according to the compression ratio setting or the engine load condition. This control valve may be a two-position selector type which sets oil relief passage 37 to be open or closed, or a continuously variable type which can continuously regulate oil pressure and oil flow.

Referring now to FIGS. 2A and 2B, there is shown a first embodiment of the present invention. In the first embodiment, valve 38 such as a solenoid valve is provided to open or close oil relief passage 37. Valve 38 is operated by a control unit such as an engine control unit according to the compression ratio setting.

As shown in FIG. 2A, oil relief passage 37 is opened by valve 38 at a high compression ratio setting mainly applied to a low engine load condition. In this way, a part of the oil is relieved from main oil gallery 33 via oil relief passage 37 to lower the oil pressure in main oil gallery 33. Accordingly, the work loss of oil pump 31 is reduced to improve fuel efficiency under a low engine load condition. On the other hand as shown in FIG. 2B, oil relief passage 37 is closed by valve 38 at a low compression ratio setting mainly applied to a high engine load condition. In this way, no oil is relieved via oil relief passage 37 to keep a high oil pressure. Accordingly, the lubricated elements are enough supplied with lubricating oil to prevent a lubrication failure under a high engine load condition.

Figure 3A:
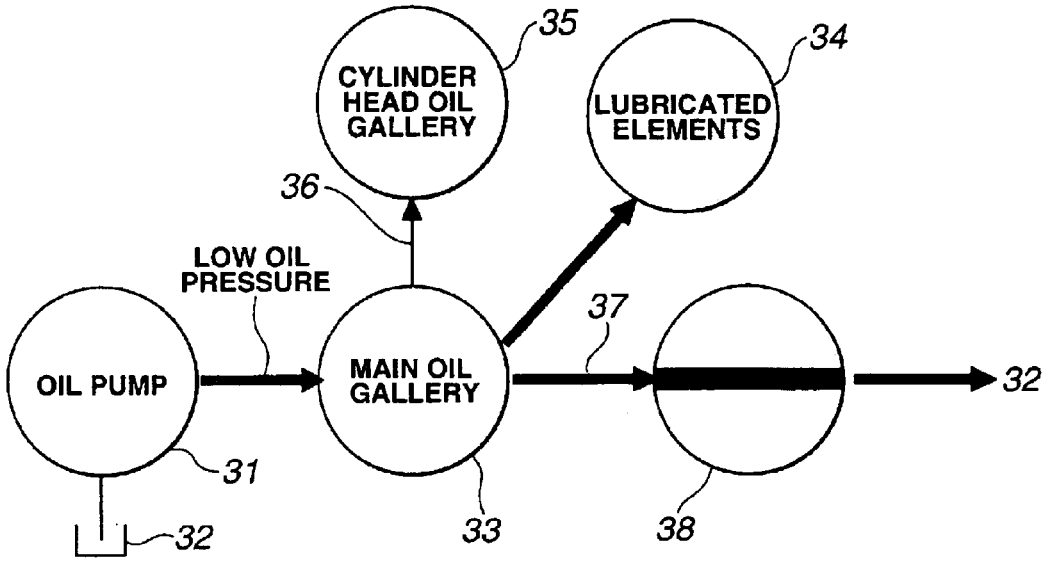
FIG. 3A is a block diagram depicting a lubrication system of a 2nd embodiment of the present invention under a low engine speed and low engine load condition.
Figure 3B:
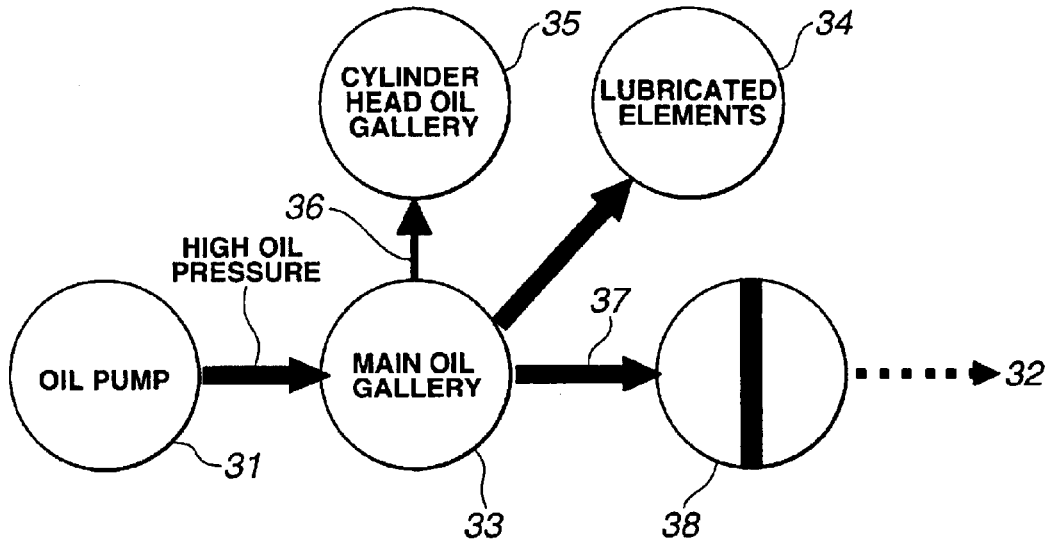
FIG. 3B is a block diagram depicting the lubrication system of the 2nd embodiment of the present invention under a high engine speed and high engine load condition.

Referring now to FIGS. 3A and 3B, there is shown a second embodiment of the present invention. In the second embodiment, valve 38 such as a solenoid valve is operated according not to the compression ratio setting but to the engine load (more specifically a target driving torque calculated on variable factors such as an accelerator opening. In detail shown in FIG. 3A, oil relief passage 37 is opened by valve 38 under a low engine speed and low engine load condition to lower the oil pressure in main oil gallery 33. On the other hand as shown in FIG. 3B, oil relief passage 37 is closed by valve 38 under a high engine speed and high engine load condition to keep a high oil pressure in main oil gallery 33. In this way, there are provided similar effects as in the case of the first embodiment.

In General, a high compression ratio setting is applied to a low engine speed and low engine load condition. For instance, however, a low compression ratio setting is applied to a low engine speed and low engine load condition by way of exception where temperatures of oil and water are high just after a high engine load operation. In this state, the oil pressure in main oil gallery 33 can be properly changed or regulated by controlling oil pressure according to the engine load.

Figure 4A:
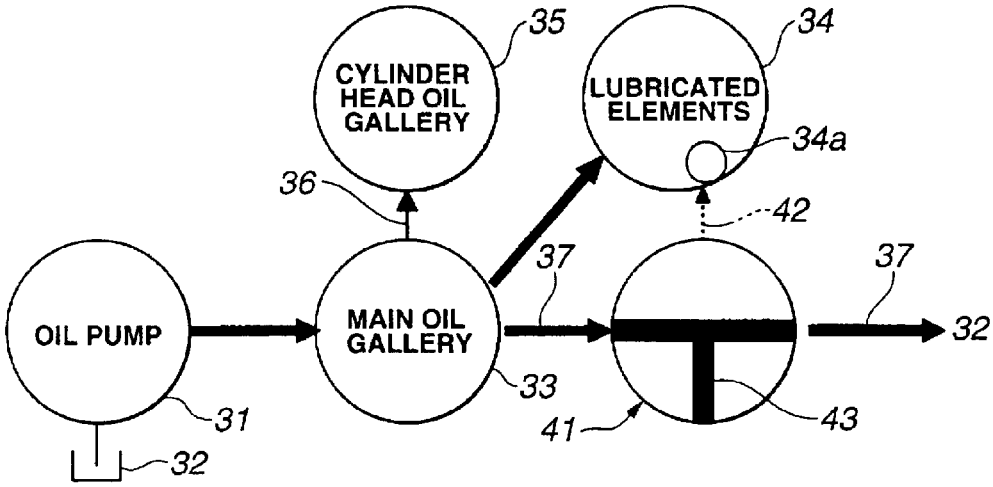
FIG. 4A is a block diagram depicting a lubrication system of a 3rd embodiment of the present invention at a high engine compression ratio setting.
Figure 4B:
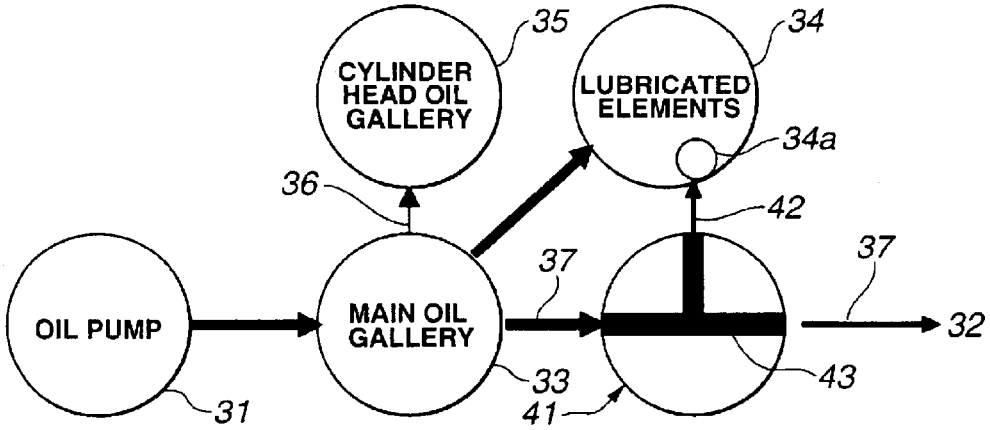
FIG. 4B is a block diagram depicting the lubrication system of the 3rd embodiment of the present invention at another high engine compression ratio setting.
Figure 4C:
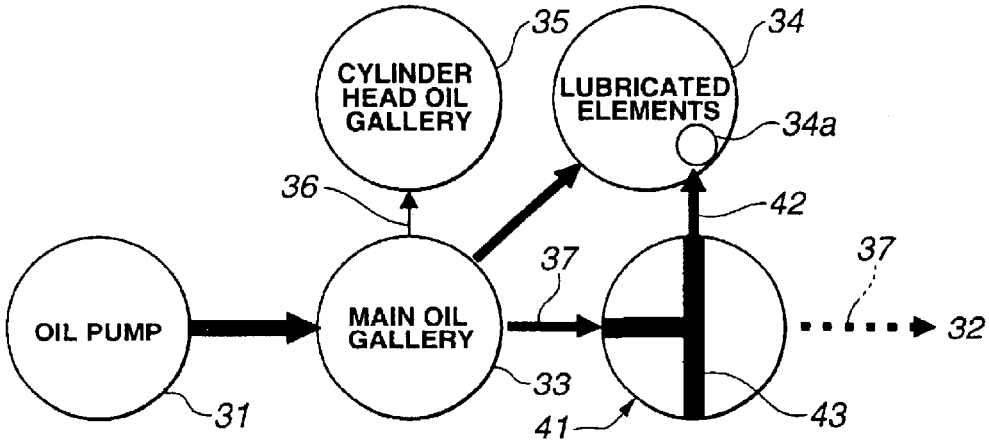
FIG. 4C is a block diagram depicting the lubrication system of the 3rd embodiment of the present invention at a low engine compression ratio setting.

Referring now to FIGS. 4A, 4B and 4C, there is shown a third embodiment of the present invention. In the third embodiment, a valve 41 such as a solenoid valve is placed in oil relief passage 37 to open or close oil relief passage 37 and to change or regulate the oil supply and the oil supply pressure to a particular lubricated element subset 34*a*. Valve 41 changes the distribution of the oil supply and the oil supply pressure to each lubricated element such as a valve train, a camshaft bearing and a crankshaft bearing, which needs lubrication, according to the compression ratio setting. In detail, valve 41 is connected to partial oil supply passage 42 which is connected to lubricated element subset 34*a*, and is provided with in-valve oil passage 43 which is simply shown as a T-shape in the figures, to open or close oil relief passage 37 and/or partial oil supply passage 42.

As shown in FIG. 4A, oil relief passage 37 is opened and partial oil supply passage 42 is closed at a first high compression ratio setting. In this way, the oil pressure in main oil gallery 33 is lowered via oil relief passage 37 to prevent an unnecessary work loss of oil pump 31. Partial oil supply passage 42 is closed so that lubricating oil is not supplied to lubricated element subset 34*a* by priority.

As shown in FIG. 4B, oil relief passage 37 and partial oil supply passage 42 are both opened by valve 41 at a second high compression ratio setting (for example, the compression ratio is lower than that of the first high compression ratio setting). In this way, the oil pressure in main oil gallery 33 is lowered via oil relief passage 37 to prevent an unnecessary loss of oil pump 31. Lubricating oil is supplied to lubricated element subset 34*a* via partial oil supply passage 42 by priority to increase the oil flow and the oil pressure in lubricated element subset 34*a* relative to other lubricated elements. Accordingly, potential inadequate lubrication for lubricated element subset 34*a* can be effectively avoided.

As shown in FIG. 4C, oil relief passage 37 is closed and partial oil supply passage 42 is opened at a low compression ratio setting mainly applied to a high engine load condition. In this way, lubricating oil is supplied to lubricated element subset 34*a* via partial oil supply passage 42 by priority while the oil pressure in main oil gallery 33 is not lowered by oil relief passage 37. Accordingly, potential inadequate lubrication for lubricated element subset 34*a* can be effectively avoided.

In the third embodiment, similar effects as in the case of the first embodiment is provided. In addition, the oil distribution to lubricated element subset 34*a* can be properly changed according to the compression ratio setting, to supply a proper amount of lubricating oil to each lubricated element according to the compression ratio setting. The lubricated elements where a small amount of oil supply is enough at a high compression ratio and low engine load condition, that is, lubricated elements except lubricated element subset 34*a* includes a piston skirt, a cylinder bore, and the sliding surfaces of main moving elements such as a crankshaft and crankpin bearings. In general, a reciprocating engine of a single link type where a single connecting rod connects a piston pin to a crankpin, structurally has a uniquely defined angle of the connecting rod from the piston stroke line according to the piston stroke position. Accordingly, a relatively large piston thrust load is imposed by the burning pressure under a low engine speed range corresponding to a high fuel efficiency range. Therefore a relatively large amount of oil supply is necessary for the piston skirt and the cylinder bore. On the other hand, when the aforementioned variable compression ratio mechanism is applied, upper link 5 corresponding to the connecting rod of the single link type can keep a geometry closely along the piston stroke line in a burning time period. Accordingly, a piston thrust load caused by the burning pressure can be greatly reduced. Therefore the oil supply to the piston skirt and the cylinder bore can be reduced under a low engine speed and low engine load condition corresponding to a high fuel efficiency range.

The input load mainly varies according to the burning pressure and the inertial load at the sliding surfaces of main moving elements such as a crankshaft and crankpin bearings. A small amount of oil supply is enough when the input load is small, for example, under a low engine load condition. Necessary oil supply increases with the input load. On the other hand at sliding surfaces in the cylinder head such as a valve train and a camshaft, a change of a necessary oil supply according to the input load is smaller than that of the sliding surfaces of the main moving elements. Therefore as shown in the embodiment, properly changing the proportion of the oil supply to the sliding surfaces of the main moving elements and the sliding surfaces in the cylinder head according to a compression ratio setting (or an engine load condition) results in decreasing an unnecessary loss of oil pump 31 and in allocating just enough oil supply necessary for each sliding surface.

When the compression ratio is varied in a reciprocating engine with a variable compression ratio mechanism, moving elements which consist of a variable compression ratio mechanism mechanically operates. When a valve as means for controlling the oil pressure as mentioned above consists of the moving elements of the variable compression ratio mechanism, a structure and a control of the system are greatly simplified. For instance as shown in the following embodiments, parts of an oil relief passage is formed both in the moving element of the variable compression ratio mechanism and in a housing which supports the moving element allowing a motion of the moving element. The oil relief passage is opened or closed according to a position of the moving element which functions as a valve.

Figure 6A:
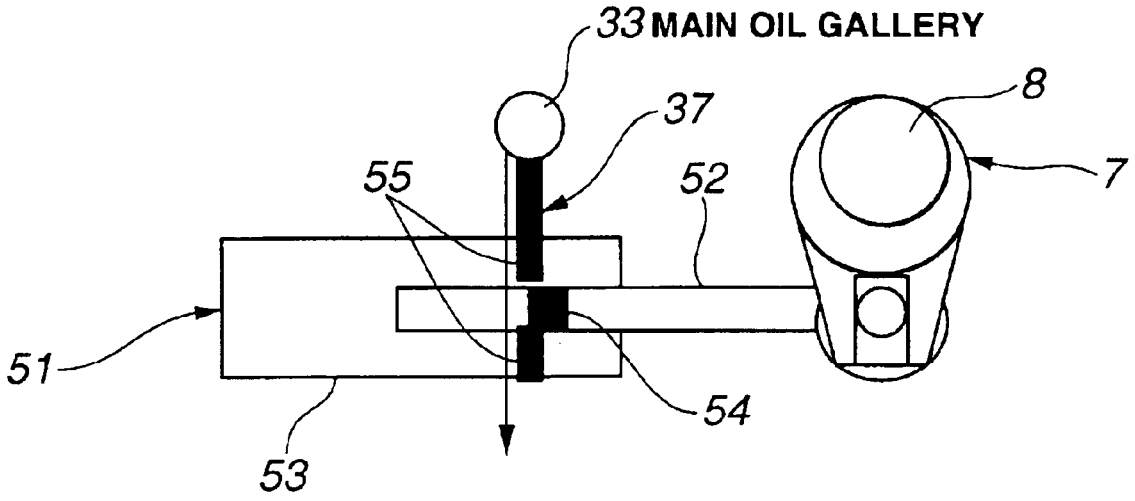
FIG. 6A is a block diagram depicting a lubrication system of the 4th embodiment of the present invention at a high engine compression ratio setting.
Figure 6B:
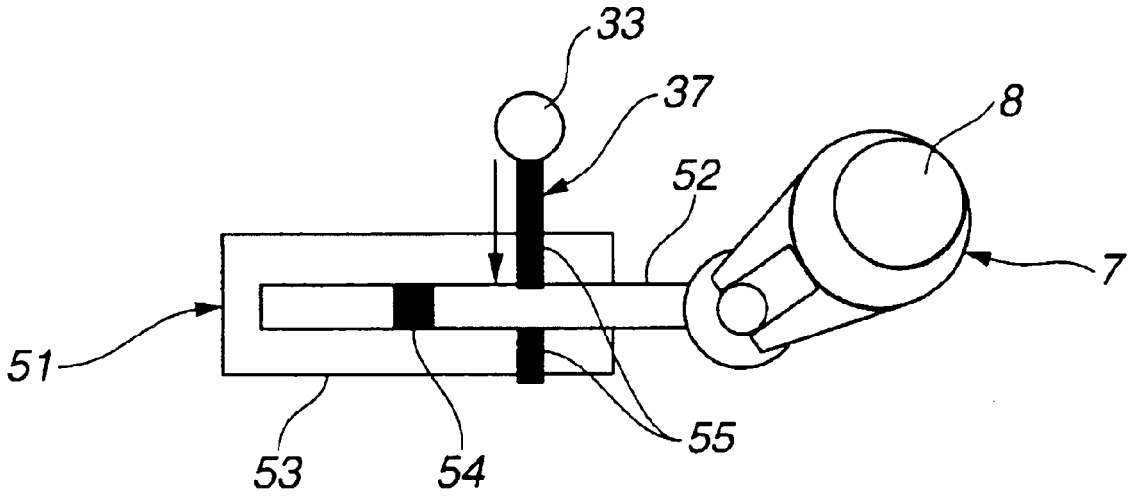
FIG. 6B is a block diagram depicting the lubrication system of the 4th embodiment of the present invention at a low engine compression ratio setting.

Referring now to FIGS. 5, 6A, and 6B, there is shown a 4th embodiment of the present invention. Compression-ratio control actuator 51 for regulating the rotation angle of control shaft 7 includes a piston rod 52 connected to control shaft 7, and a piston housing 53 for slidably supporting piston rod 52. Piston rod 52 slides in piston housing 53 to regulate the rotation angle of control shaft 7. In this embodiment, piston rod 52 functions as a valve. In detail, a pair of partial oil relief passages 55 is formed in piston housing 53 as a part of oil relief passage 37. An in-valve oil passage 54 is formed in piston rod 52.

As shown in FIG. 6A, piston rod 52 is positioned to communicate in-valve oil passage 54 with partial oil relief passage 55 at a high compression ratio setting mainly applied to a low engine load condition. In this state, oil is relieved from main oil gallery 33 via oil relief passage 37 to lower the oil pressure in main oil gallery 33. An unnecessary work loss of oil pump 31 is thus avoided. On the other hand as shown in FIG. 6B, piston rod 52 is positioned to close partial oil relief passage 55 at a low compression ratio setting mainly applied to a high engine load condition. In this state, oil is not relieved from main oil gallery 33 via oil relief passage 37. Thus, the oil pressure in main oil gallery 33 is kept high and the oil supply pressure for the lubricated elements is enough allocated.

As shown in this embodiment, piston rod 52 of compression-ratio control actuator 51 which moves control shaft 7 functions as a valve to open or close oil relief passage 37. Accordingly, it is not necessary to provide an additional valve and a control unit for the valve, which leads to a simplification of the structure and the control of the system.

Referring now to FIGS. 7A through 8B, there is shown a 5th embodiment of the present invention. In the 5th embodiment, a journal 7*a* of control shaft 7 functions as a valve to open or close oil relief passage 37 hydraulically connected to main oil gallery 33. In detail, an in-valve oil passage 61 is formed in journal 7*a* of control shaft 7. Partial oil relief passages 62 and 63 are formed in bearing caps 22 and 24 supporting journal 7*a*, and are open to the abutting surface of journal 7*a*.

Figure 7A:
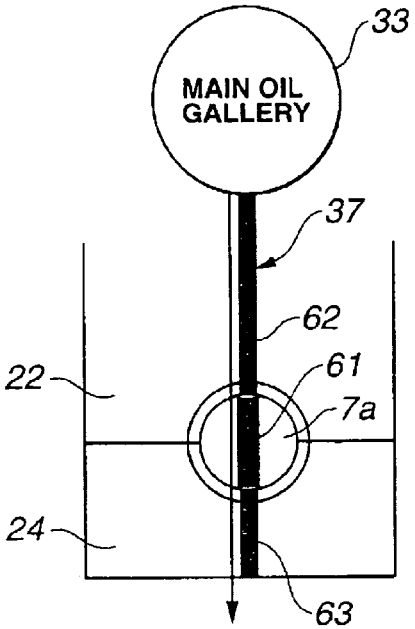
FIG. 7A is a cross-sectional view taken along the plane indicated by the line VIIA—VIIA in FIG. 7B, depicting a lubrication system of a 5th embodiment of the present invention, which includes a control shaft as a part of the system, at a high engine compression ratio setting.
Figure 7B:
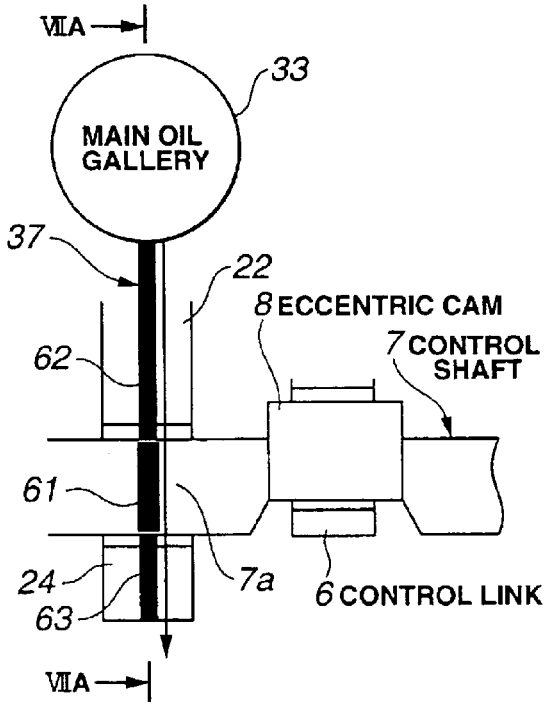
FIG. 7B is a block diagram depicting the lubrication system of the 5th embodiment of the present invention at the high engine compression ratio setting.

As shown in FIGS. 7A and 7B, the rotation angle of control shaft 7 is regulated to open oil passages 61 through 63 at a high compression ratio setting mainly applied to a low engine load condition. In this state, a part of the oil in main oil gallery 33 is relieved via oil relief passage 37. Accordingly, the oil pressure in main oil gallery 33 is lowered to prevent an unnecessary work loss of oil pump 31.

Figure 8A:
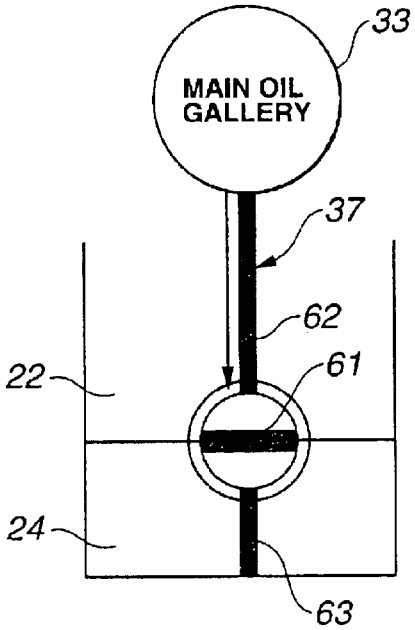
FIG. 8A is a cross-sectional view taken along the plane indicated by the line VIIIA—VIIIA in FIG. 8B, depicting the lubrication system of the 5th embodiment of the present invention at a low engine compression ratio setting.
Figure 8B:
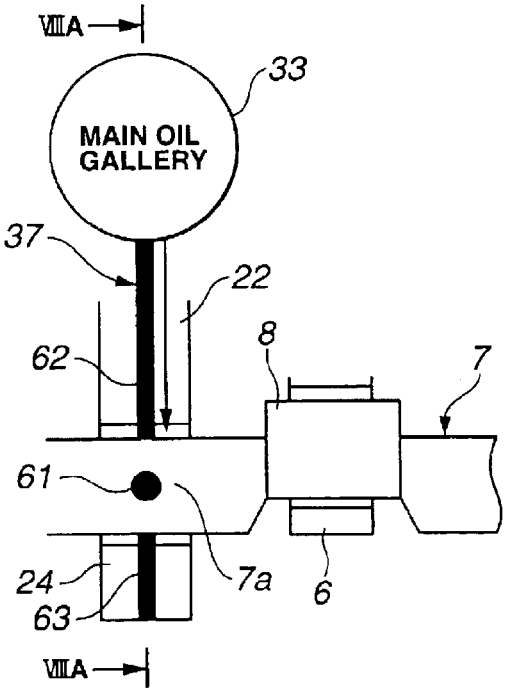
FIG. 8B is a block diagram depicting the lubrication system of the 5th embodiment of the present invention at the low engine compression ratio setting.

On the other hand as shown in FIGS. 8A and 8B, partial oil relief passages 62 and 63 are not communicated with each other by in-valve oil passage 61 at a low compression ratio setting mainly applied to a high engine load condition. In this way, oil pressure in main oil gallery 33 is not lowered by oil relief passage 37 and is kept high so that oil pressure for each lubricated element can be allocated to provide a desirable lubrication.

As shown above in the 5th embodiment, journal 7*a* of control shaft 7 of the variable compression ratio mechanism functions as a valve to determine the opening of oil relief passage 37 according to the compression ratio setting. Accordingly, it is not necessary to provide an additional valve and a control unit for the valve, which leads to a simplification of the structure and the control of the system. The oil passage which supplies lubricating oil to the sliding surfaces of journal 7*a* of control shaft 7 is utilized as a part of oil relief passage 37 to simplify the structure additionally.

Referring now to FIGS. 9A through 10C, there is shown a 6th embodiment of the present invention. In the 6th embodiment, journal 7*a* of control shaft 7 functions as a valve to open or close oil relief passage 37 as in the case of the 5th embodiment. In detail, an in-valve oil passage 65 through 67 are formed in control shaft 7 as a part of oil relief passage 37. A partial oil relief passage 64 is formed in crankshaft bearing cap 22. In-valve oil passage 65 through 67 consists of an axial-direction oil passage 66 extending along the axial direction of control shaft 7, a first radial-direction oil passage 65 connecting axial-direction oil passage 66 to the outer surface of journal 7*a*, and a second radial-direction oil passage 67 connecting axial-direction oil passage 66 to the outer surface of eccentric cam 8.

Figure 9A:
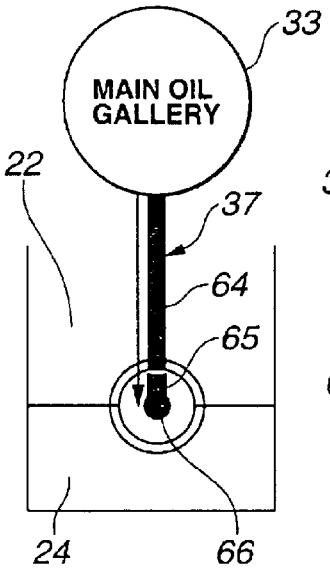
FIG. 9A is a cross-sectional view taken along the plane indicated by the line IXA—IXA in FIG. 9B, depicting a lubrication system of a 6th embodiment of the present invention, which includes a control shaft as a part of the system, at a high engine compression ratio setting.
Figure 9B:
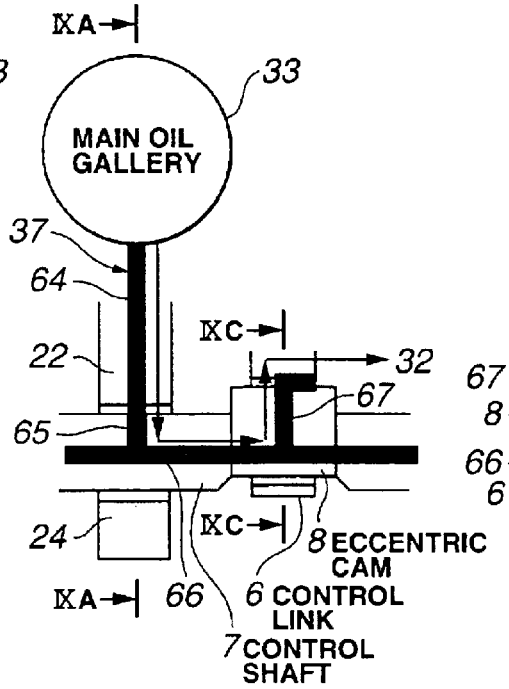
FIG. 9B is a block diagram depicting the lubrication system of the 6th embodiment of the present invention at the high engine compression ratio setting.
Figure 9C:
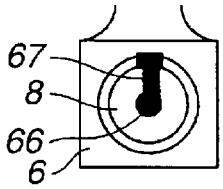
FIG. 9C is a cross-sectional view taken along the plane indicated by the line IXC—IXC in FIG. 9B, depicting the lubrication system of the 6th embodiment of the present invention at the high engine compression ratio setting.

As shown in FIGS. 9A through 9C, in-valve oil passage 65 through 67 is connected to partial oil relief passage 64 at a high compression ratio setting (or at a rotation angle of the control shaft corresponding to the high compression ratio) mainly applied to a low load range. In this state, lubricating oil is supplied to the outer surface of eccentric cam 8 from main oil gallery 33 via oil relief passage 37. After lubricating the sliding surface of eccentric cam 8, the lubricating oil finally returns to oil pan 32. Thus, the oil pressure in main oil gallery 33 is lowered due to this oil relief from main oil gallery 33 via oil relief passage 37. Accordingly, an unnecessary work loss of oil pump 31 is avoided to improve fuel efficiency.

Figure 10A:
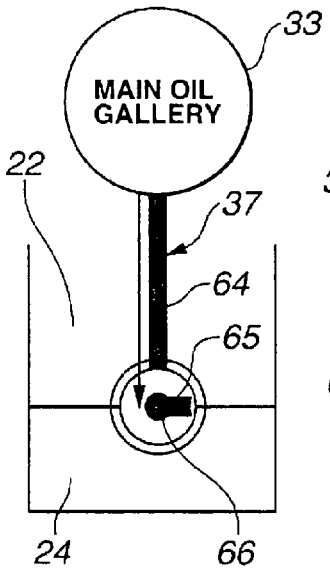
FIG. 10A is a cross-sectional view taken along the plane indicated by the line XA—XA in FIG. 10B, depicting the lubrication system of the 6th embodiment of the present invention at a low engine compression ratio setting.
Figure 10B:
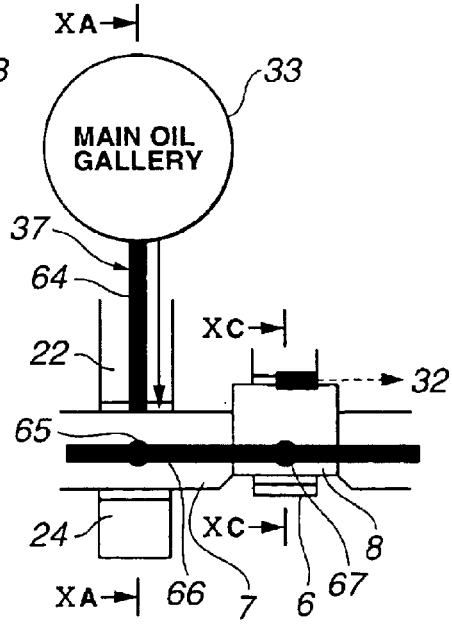
FIG. 10B is a block diagram depicting the lubrication system of the 6th embodiment of the present invention at the low engine compression ratio setting.
Figure 10C:
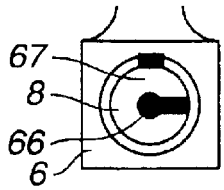
FIG. 10C is a cross-sectional view taken along the plane indicated by the line XC—XC in FIG. 10B, depicting the lubrication system of the 6th embodiment of the present invention at the low engine compression ratio setting.

On the other hand shown in FIGS. 10A through 10C, in-valve oil passage 65 through 67 is not connected to partial oil relief passage 64, that is, oil relief passage 37 is closed at a low compression ratio setting mainly applied to a high engine load condition. In this state, oil is not relieved from main oil gallery 33 via oil relief passage 37. The oil pressure in main oil gallery 33 is kept high so that oil is enough supplied to each lubricated element.

As shown above in the 6th embodiment, control shaft 7 and crankshaft bearing cap 22 of the variable compression ratio mechanism function as a valve to determine the opening of oil relief passage 37 according to the compression ratio setting. Accordingly, it is not necessary to provide an additional valve and a control unit for the valve, which leads to a simplification of the structure and the control of the system. The oil passage which supplies lubricating oil to the sliding surfaces of journal 7*a* and eccentric cam 8 of control shaft 7 are utilized as a part of oil relief passage 37 to simplify the structure additionally.

In addition, when partial oil relief passage 63 is formed in control-shaft bearing cap 24 as in the case of the 5th embodiment, it is possible to regulate the oil pressure and the oil flow more precisely by two stages in combination with the aforementioned oil relief from eccentric cam 8.

Figure 11A:
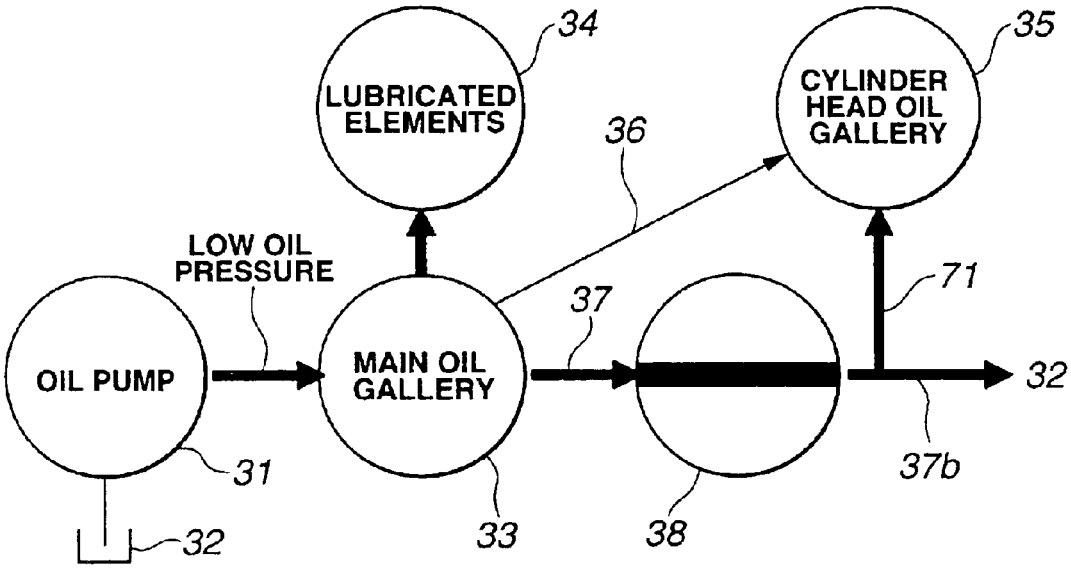
FIG. 11A is a block diagram depicting a lubrication system of a 7th embodiment of the present invention at a high engine compression ratio setting.
Figure 11B:
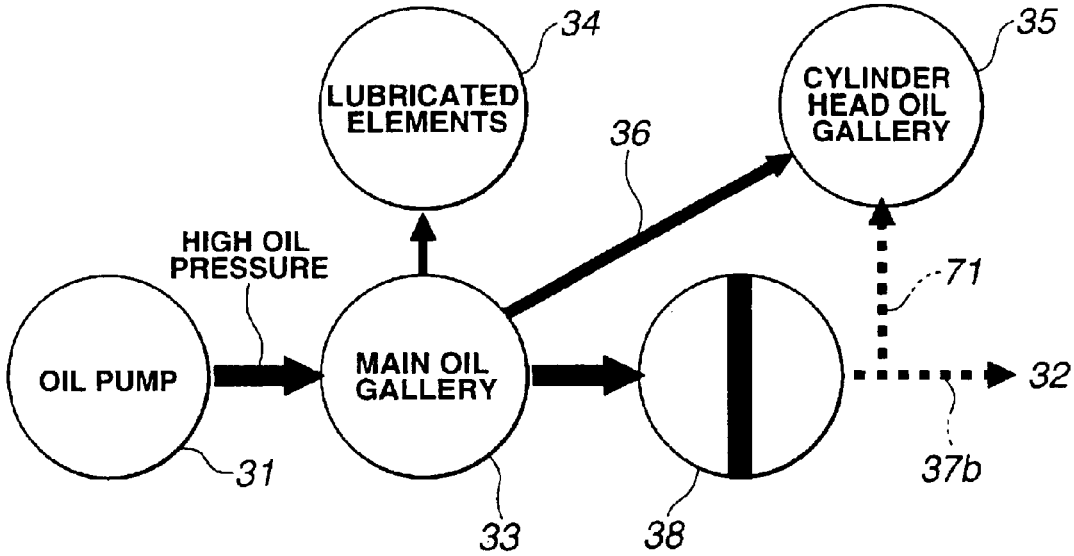
FIG. 11B is a block diagram depicting the lubrication system of the 7th embodiment of the present invention at a low engine compression ratio setting.
Figure 12:
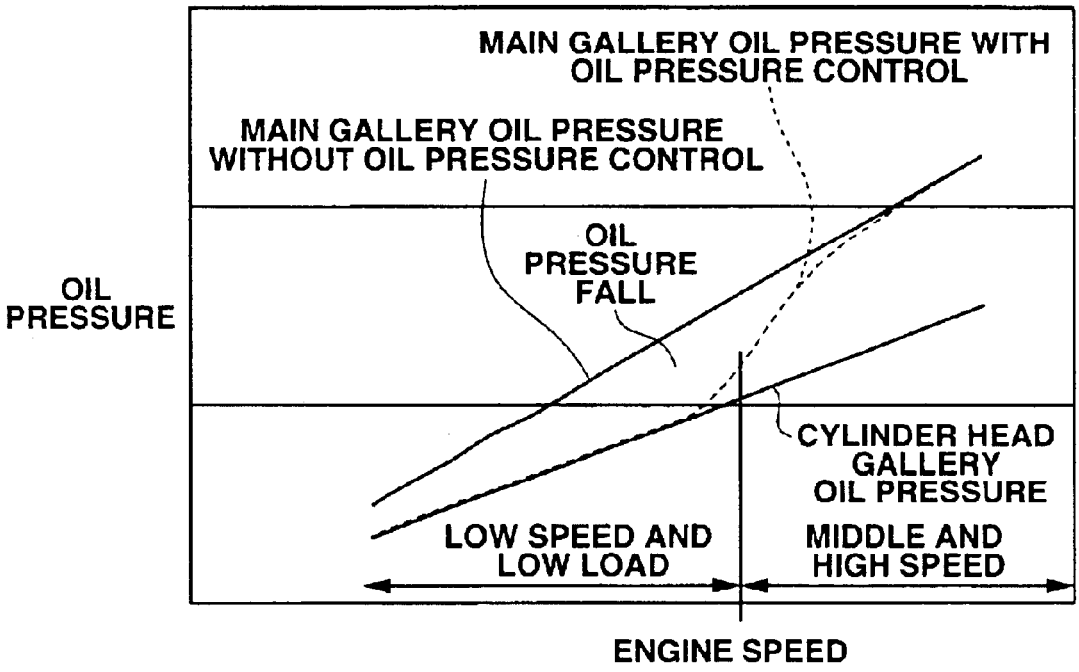
FIG. 12 is a graph depicting characteristic curves of oil pressures in relation to an engine speed, in a main oil gallery and a cylinder head oil gallery of the 7th embodiment of the present invention.

Referring now to FIGS. 11A, 11B and 12, there is shown a 7th embodiment of the present invention. The pressure of the oil discharged from oil pump 31 driven by crankshaft 1 is low at a low engine speed, and high at a high engine speed. Accordingly in general, an orifice is provided in the oil passage between the main oil gallery and the cylinder head oil gallery to lower oil pressure in the cylinder head oil gallery relative to that in the main oil gallery in the high engine speed range. In this way, when the engine speed rises high, the oil pressure in the cylinder head oil gallery is prevented from excessively rising to oversupply oil to the valve train. On the other hand, it is necessary to prevent a shortage of the oil flow supplied to the cylinder head oil gallery in the low engine speed range. Accordingly, the capacity of the oil pump is enlarged to raise the oil pressure in main oil gallery, for allocating the oil pressure in the cylinder head oil gallery. In this state, the oil pressure in the main oil gallery excessively rises in the high engine speed range. It is necessary to keep the oil pressure constant by relieving a part of the oil. Therefore a work loss of the oil pump is increased to lower fuel efficiency. Necessary oil flow for lubricated elements such as a valve train in the cylinder head varies according not to the engine rotation speed, but mainly to the engine load. While the oil pressure in the cylinder head oil gallery is not necessary to be greatly varied according to the engine rotation speed, the oil pressure in the main oil gallery is necessary to be raised to supply larger oil under a higher speed and higher engine load condition. In this embodiment, the oil pressure variation in the cylinder head oil gallery corresponding to the compression ratio variation is made smaller than that in the main oil gallery. In this way, it is possible to supply oil to the cylinder head oil gallery without an unnecessary work loss of the oil pump. The capacity of the oil pump can be decreased to improve fuel efficiency.

Specifically, valve 38 is provided in oil relief passage 37 connected to main oil gallery 33, to regulate the opening of oil relief passage 37. A cylinder head sub oil supply passage 71 is provided for connecting a downstream oil passage 37*b* of oil relief passage 37 to cylinder head oil gallery 35. The oil flow resistance of cylinder head sub oil supply passage 71 is set to be smaller than that of cylinder head main oil supply passage 36 which is directly connected to main oil gallery 33 and to cylinder head oil gallery 35. In this state, the oil pressure fall between main oil gallery 33 and cylinder head oil gallery 35 via cylinder head sub oil supply passage 71 is smaller than via cylinder head main oil supply passage 36, so that the difference between the oil pressure in cylinder head oil gallery 35 and the oil pressure in main oil gallery 33 is small.

As shown in FIG. 11A, oil relief passage 37 is opened by valve 38 at a high compression ratio setting applied to a low engine speed and low engine load condition. Accordingly as shown in FIG. 12, the oil pressure in main oil gallery 33 is lowered to avoid an unnecessary work loss of oil pump 31. In addition, the lubricating oil is supplied to cylinder head oil gallery 35 mainly via cylinder head sub oil supply passage 71 with a small flow resistance, to reduce relatively the oil pressure fall in cylinder head oil gallery 35, so that an inadequate lubrication is prevented in the lubricated elements in the cylinder head.

As shown in FIG. 11B, oil relief passage 37 is closed by valve 38 at a low compression ratio setting applied to a middle-high engine speed and high engine load condition. In this way, the lubricating oil is not relieved from main oil gallery 33 via oil relief passage 37. As shown in FIG. 12, the oil pressure in main oil gallery 33 is kept high to supply the lubricating oil for each lubricated element. The lubricated oil is supplied to cylinder head oil gallery 35 from main oil gallery 33 only via cylinder head main oil supply passage 36. Thus, the oil pressure in the cylinder head is not excessively raised, so that the lubricating oil is properly supplied to the lubricated elements in the cylinder head.

Figure 13A:
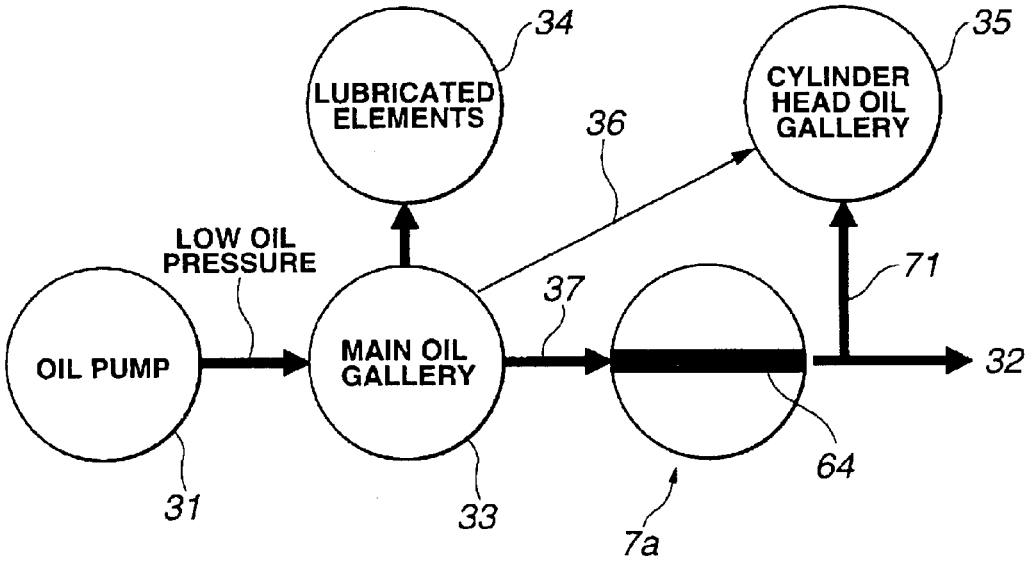
FIG. 13A is a block diagram depicting a lubrication system of a 8th embodiment of the present invention at a high engine compression ratio setting.
Figure 13B:
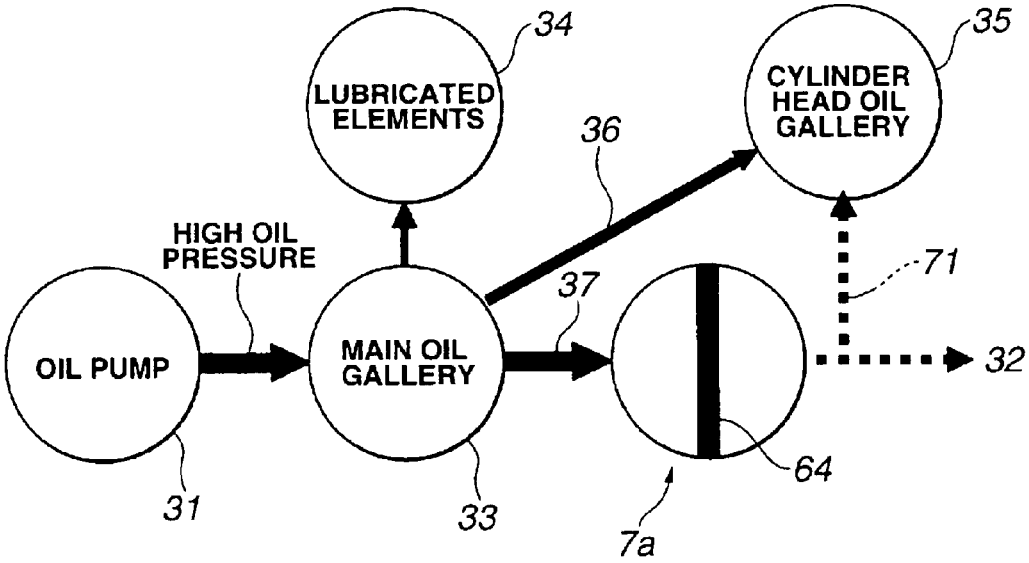
FIG. 13B is a block diagram depicting the lubrication system of the 8th embodiment of the present invention at a low engine compression ratio setting.

Referring now to FIGS. 13A and 13B, there is shown an 8th embodiment. In this embodiment, journal 7*a* of control shaft 7 functions as a valve as in the case of the 5th embodiment, which is the only difference from the 7th embodiment. Specifically, partial oil relief passage 64 is formed as a part of oil relief passage 37 in journal 7*a* of control shaft 7. When control shaft 7 is rotated to vary the compression ratio setting, oil relief passage 37 is opened or closed accordingly. In the 8th embodiment, similar effects as in the case of the 5th embodiment are provided in addition to similar effects as in the case of the 7th embodiment.

Figure 14A:
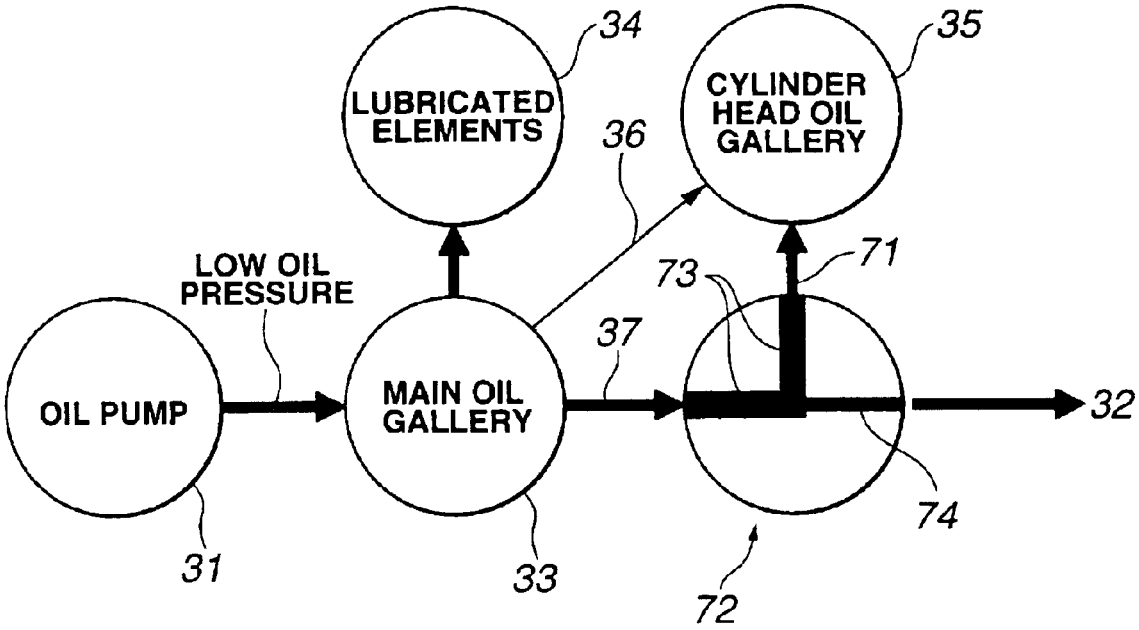
FIG. 14A is a block diagram depicting a lubrication system of a 9th embodiment of the present invention at a high engine compression ratio setting.
Figure 14B:
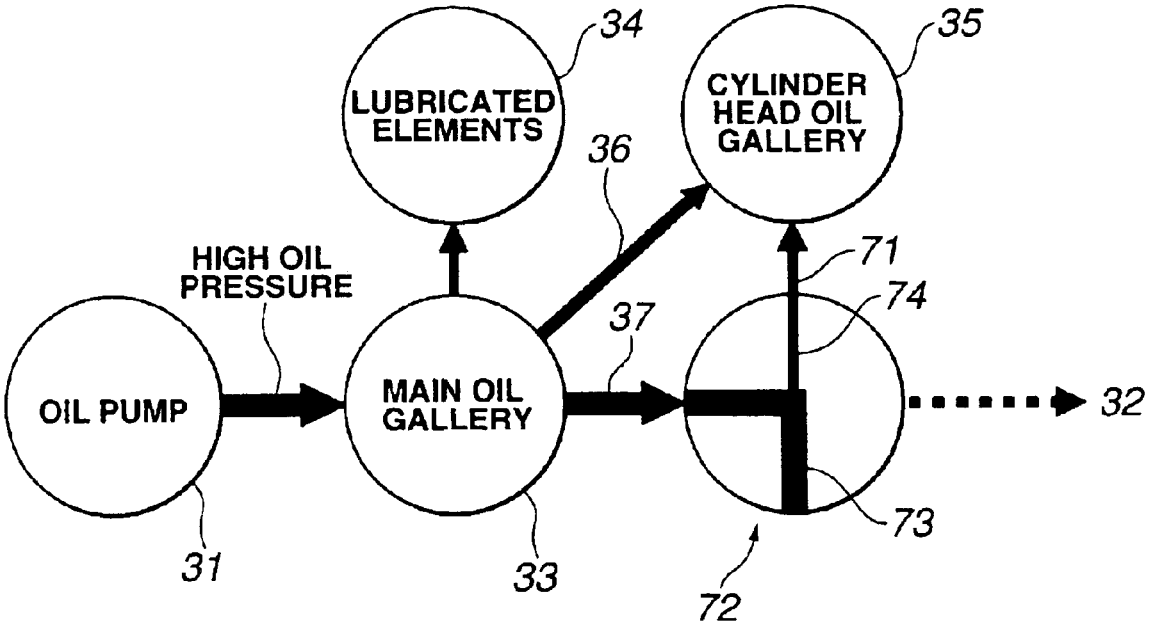
FIG. 14B is a block diagram depicting the lubrication system of the 9th embodiment of the present invention at a low engine compression ratio setting.

Referring now to FIGS. 14A and 14B, there is shown a 9th embodiment. In this embodiment, cylinder head sub oil supply passage 71 is connected to a valve 72 provided in oil relief passage 37. Valve 72 opens or closes oil relief passage 37 connected to main oil gallery 33 and also has a function of opening or closing cylinder head sub oil supply passage 71. Two in-valve oil passages which have different cross-sectional areas and different oil flow resistances are provided in valve 72. One is a thick oil passage 73 which has a large cross-sectional area and a small oil flow resistance, and the other is a thin oil passage 73 which has a small cross-sectional area and a large oil flow resistance. Valve 72 may be replaced by journal 7*a* of control shaft 7 as in the case of the 7th embodiment.

As shown in FIG. 14A, cylinder head sub oil supply passage 71 is opened in addition to oil relief passage 37 by valve 72 at a high compression ratio setting applied to a low engine load condition. Oil relief passage 37 is connected to cylinder head sub oil supply passage 71 only via thick oil passage 73 with a small oil flow resistance. Accordingly, the oil pressure fall in cylinder head oil gallery 35 relative to that in main oil gallery 33 is reduced.

As shown in FIG. 14B, oil relief passage 37 is closed and cylinder head sub oil supply passage 71 is opened by valve 72 at a low compression ratio setting applied to a high engine load condition. Oil relief passage 37 is connected to cylinder head sub oil supply passage 71 via both thick oil passage 73 and thin oil passage 73 in series. Accordingly, the oil pressure fall in cylinder head oil gallery 35 relative to the oil pressure in main oil gallery 33 is smaller than in the case of connecting only via thick oil passage 73.

In the aforementioned embodiment, similar effects as in the case of the 8th embodiment is provided. In addition, the oil supply and the oil pressure for the cylinder head gallery are regulated more specifically.

The entire contents of Japanese Patent Application No. 2003-45709 (filed Feb. 24, 2003) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A reciprocating engine comprising:

a variable compression ratio mechanism for regulating an engine compression ratio according to an engine load;

a main oil passage;

an oil pressure source hydraulically connected to the main oil passage for supplying pressurized lubricating oil to the main oil passage;

an oil supply passage hydraulically connecting the main oil passage to a lubricated element; and an oil pressure control device for controlling an oil pressure in the main oil passage for the lubricated element according to the engine compression ratio, the oil pressure control device comprising a mechanism for varying a relative distribution of an oil supply pressure for a lubricated element subset according to the engine compression ratio.

2. The reciprocating engine as claimed in claim 1 wherein:

the oil pressure control device lowers the oil pressure in the main oil passage at a high compression ratio setting and keeps the oil pressure in the main oil passage at a low compression ratio setting.

3. A reciprocating engine comprising:

a variable compression ratio mechanism for regulating an engine compression ratio according to an engine load;

a main oil passage;

an oil pressure source hydraulically connected to the main oil passage for supplying pressurized lubricating oil to the main oil passage;

an oil supply passage hydraulically connecting the main oil passage to a lubricated element; and an oil pressure control device for controlling an oil pressure in the main oil passage according to the engine compression ratio, and for lowering the oil pressure in the main oil passage at a low compression ratio when an oil temperature of the lubricating oil is high.

4. A reciprocating engine comprising:

a variable compression ratio mechanism for regulating an engine compression ratio according to an engine load;

a main oil passage;

an oil pressure source hydraulically connected to the main oil passage for supplying pressurized lubricating oil to the main oil passage;

an oil supply passage hydraulically connecting the main oil passage to a lubricated element;

an oil pressure control device for controlling an oil pressure in the main oil passage according to the engine compression ratio;

a cylinder head oil gallery adapted to be formed in a cylinder head;

a cylinder head main oil passage hydraulically connecting the main oil passage to the cylinder head oil gallery;

a cylinder head sub oil passage hydraulically connecting the main oil passage to the cylinder head oil gallery; and a cylinder head oil pressure control device provided in the cylinder head sub oil passage for controlling an oil supply pressure for the cylinder head oil gallery from the main oil passage, wherein the main oil passage comprises a main oil gallery formed in a cylinder block.

5. The reciprocating engine as claimed in claim 4 wherein:

a fluid resistance of the cylinder head sub oil passage is smaller than that of the cylinder head main oil passage; and the cylinder head oil pressure control device opens the cylinder head sub oil passage at a high compression ratio setting and closes the cylinder head sub oil passage at a low compression ratio setting.

6. The reciprocating engine as claimed in claim 4 wherein:

the cylinder head oil pressure control device comprises:

an oil relief passage for relieving lubricating oil from the main oil gallery; and a control valve for regulating an opening of the oil relief passage according to a compression ratio setting, and the cylinder head sub oil passage is connected downstream of the oil relief passage from the control valve.

7. The reciprocating engine claimed as claim 6 wherein:

the control valve comprises:

a thick in-valve oil passage having a smaller fluid resistance; and a thin in-valve oil passage having a larger fluid resistance;

the control valve opens the oil relief passage;

the oil relief passage is connected to the cylinder head sub oil passage only via the thick in-valve oil passage at a high compression ratio setting; and the control valve closes the oil relief passage, and the oil relief passage is connected to the cylinder head sub oil passage via the thin in-valve oil passage at a low compression ratio setting.

8. A reciprocating engine comprising:

a variable compression ratio mechanism for regulating an engine compression ratio according to an engine load;

a main oil passage;

an oil pressure source hydraulically connected to the main oil passage for supplying pressurized lubricating oil to the main oil passage;

an oil supply passage hydraulically connecting the main oil passage to a lubricated element; and an oil pressure control device for controlling an oil pressure in the main oil passage according to the engine compression ratio, wherein the oil pressure control device comprises:

an oil relief passage for relieving a lubricating oil from the main oil passage; and a control valve for regulating an opening of the oil relief passage according to an engine compression ratio setting, the control valve comprising a moving element of the variable compression ratio mechanism for being moved during the engine compression ratio setting being varied and for being positioned according to the engine compression ratio setting.

9. The reciprocating engine as claimed in claim 8 wherein:

the variable compression ratio mechanism comprises:

a lower link rotatably attached to a crankpin of a crankshaft;

an upper link pivotally connected at one end to the lower link and at another end to a piston;

a control shaft rotatably supported by a cylinder block, the control shaft comprising an eccentric cam;

a control link pivotally connected at one end to the eccentric cam and at another end to the lower link;

a compression-ratio control actuator for regulating a rotation angle of the control shaft to set an engine compression ratio.

10. The reciprocating engine as claimed in claim 9 wherein:

the control shaft comprises a journal rotatably supported on the cylinder block, the journal having a portion which functions as the control valve according to the rotation angle of the control shaft.

11. The reciprocating engine as claimed in claim 10 wherein:

the control shaft comprises an in-valve oil passage formed as a part of the oil relief passage; and the cylinder block comprises a control-shaft bearing cap for supporting the control shaft, the control-shaft bearing cap comprising an oil passage formed as a part of the oil relief passage.

12. The reciprocating engine as claimed in claim 10 wherein:

the control shaft comprises an in-valve oil passage formed as a part of the oil relief passage, the in-valve oil passage comprising:

an axial oil passage placed along a longitudinal direction of the control shaft;

a first radial oil passage hydraulically connected at one end to the axial oil passage and at another end to an opening in an outer surface of the journal; and a second radial oil passage hydraulically connected at one end to the axial oil passage and at another end to an opening in an outer surface of the eccentric cam.

13. The reciprocating engine as claimed in claim 12 wherein:

the control shaft comprises an in-valve oil passage formed as a part of the oil relief passage; and the cylinder block comprises a control-shaft bearing cap for supporting the control shaft, the control-shaft bearing cap comprising an oil passage formed as a part of the oil relief passage.

14. The reciprocating engine as claimed in claim 9 wherein:

the compression-ratio control actuator comprises:

a piston housing rigidly attached to the engine;

a piston rod slidably supported on the piston housing and connected at one end to a periphery of the control shaft, for stroking relative to the piston housing to regulate the rotation angle of control shaft;

the piston housing having a portion formed as a part of the oil relief passage; and the piston rod having a portion formed as a part of the oil relief passage for functioning as the valve according to a position of the piston rod relative to the piston housing.

15. The reciprocating engine as claimed in claim 9 further comprising:

a cylinder head oil gallery formed in a cylinder head;

a cylinder head main oil passage hydraulically connecting the main oil passage to the cylinder head oil gallery;

a cylinder head sub oil passage hydraulically connecting the main oil passage to the cylinder head oil gallery; and a cylinder head oil pressure control device provided in the cylinder head sub oil passage for controlling an oil supply pressure for the cylinder head oil gallery from the main oil passage, wherein the main oil passage comprises a main oil gallery formed in the cylinder block.

16. The reciprocating engine as claimed in claim 15 wherein:

the control shaft comprises a journal rotatably supported on the cylinder block, the journal having a portion which functions as the control valve according to the rotation angle of the control shaft.

17. The reciprocating engine as claimed in claim 15 wherein:

the compression-ratio control actuator comprises:

a piston housing rigidly attached to the engine;

a piston rod slidably supported on the piston housing and connected at one end to a periphery of the control shaft, for stroking relative to the piston housing to regulate the rotation angle of the control shaft;

the piston housing having a portion formed as a part of the oil relief passage; and the piston rod having a portion formed as a part of the oil relief passage for functioning as the valve according to a position of the piston rod relative to the piston housing.

18. A reciprocating engine comprising:

a variable compression ratio mechanism for regulating an engine compression ratio;

a main oil passage;

an oil pressure source hydraulically connected to the main oil passage for supplying pressurized lubricating oil to the main oil passage;

an oil supply passage hydraulically connecting the main oil passage to a lubricated element; and an oil pressure control device for controlling an oil pressure in the main oil passage for the lubricated element according to an engine load which is a parameter used to determine the engine compression ratio, the oil pressure control device comprising a mechanism for varying a relative distribution of an oil supply pressure for a lubricated element subset according to the engine compression ratio.

19. A reciprocating engine comprising:

a variable compression ratio mechanism for regulating an engine compression ratio according to an engine load;

a main oil passage;

an oil pressure source hydraulically connected to the main oil passage for supplying pressurized lubricating oil to the main oil passage;

oil supply means for supplying lubricating oil from the oil pressure source via the main oil passage to a lubricated element; and oil pressure control means for controlling an oil pressure in the main oil passage for the lubricated element according to the engine compression ratio, the oil pressure control means comprising means for varying a relative distribution of an oil supply pressure for a lubricated element subset according to the engine compression ratio.

20. A reciprocating engine comprising:

a variable compression ratio mechanism for regulating an engine compression ratio;

a main oil passage;

an oil pressure source hydraulically connected to the main oil passage for supplying pressurized lubricating oil to the main oil passage;

oil supply means for supplying lubricating oil from the oil pressure source via the main oil passage to a lubricated element; and oil pressure control means for controlling an oil pressure in the main oil passage for the lubricated element according to an engine load which is a parameter used to determine the engine compression ratio, the oil pressure control means comprising means for varying a relative distribution of an oil supply pressure for a lubricated element subset according to the engine compression ratio.

21. A method of regulating an oil pressure in a main oil passage of a reciprocating engine including at least a variable compression ratio mechanism for regulating an engine compression ratio, a main oil passage, an oil pressure source hydraulically connected to the main oil passage for supplying pressurized lubricating oil to the main oil passage, an oil supply passage hydraulically connecting the main oil passage to a lubricated element, and an oil pressure control device for controlling an oil pressure in the main oil passage, the method comprising:

determining whether the engine compression ratio is high or low relative to a predetermined value;

operating the oil pressure control device for keeping the pressure in the main oil passage for the lubricated element when the engine compression ratio is low;

operating the oil pressure control device for lowering the pressure in the main oil passage for the lubricated element when the engine compression ratio is high; and varying a relative distribution of an oil supply pressure for a lubricated element subset according to the engine compression ratio.

* * * * *